United States Patent [19]

Glickman et al.

[11] 4,436,331

[45] Mar. 13, 1984

[54] MULTIPLE-POSITION HASP-TYPE DOOR CHECK

[76] Inventors: Howard E. Glickman, 4 Nantucket La., Olivette, Mo. 63132; Alan J. Broddon, 7400 Buckingham, Clayton, Mo. 63105; Norman C. Broddon, 10984 Chambray Ct., Creve Coeur, Mo. 63141

[21] Appl. No.: 319,220

[22] Filed: Nov. 9, 1981

[51] Int. Cl.[3] ..... E05C 17/16

[52] U.S. Cl. ..... 292/270

[58] Field of Search ..... 292/260, 265, 266, 267, 292/268, 270

[56] References Cited

U.S. PATENT DOCUMENTS

| | | | |
|---|---|---|---|
| 1,524,088 | 1/1925 | Ernst | 292/269 |
| 1,596,183 | 8/1926 | Horlick, Jr. | 292/270 |

FOREIGN PATENT DOCUMENTS

| | | | |
|---|---|---|---|
| 13159 | 9/1903 | Austria | 292/268 |
| 497682 | 5/1935 | Fed. Rep. of Germany | 292/268 |

OTHER PUBLICATIONS

"Racine Notched Type Door Guard", Circular of the Henry Ernst Mfg. Co., (not dated)-the wire loop referred to is believed to cooperate with the notches shown in patented hasp, U.S. Pat. No. 1,785,772 to Hallam, referred to in Specification, p. 1, line 29.

*Primary Examiner*—Richard E. Moore

*Attorney, Agent, or Firm*—Jerome A. Gross

[57] ABSTRACT

A door check of the swingable slotted hasp type provides two extents of opening, utilizing a broader width of slot which continues outward in a slot of narrower width. Two different depths of slide member are provided. In one embodiment these are spaced axially along a horizontal projection from a housing on the door. In another, the slide is oblong, and is rotatable through 90° to present the two different depths.

5 Claims, 6 Drawing Figures

FIG. 4
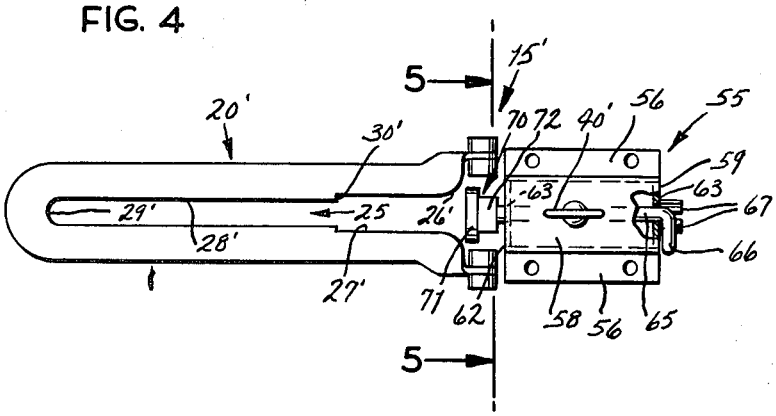
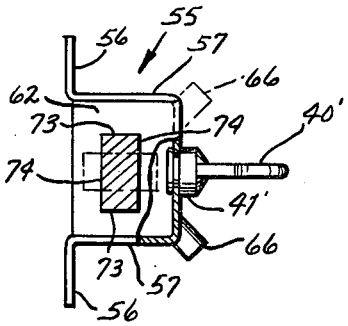
FIG. 5
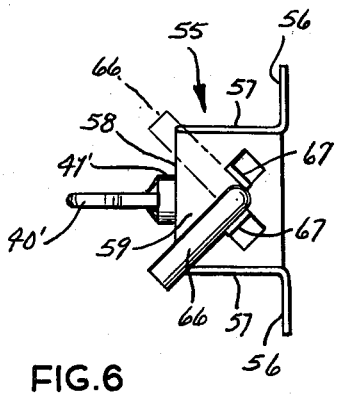
FIG. 6

MULTIPLE-POSITION HASP-TYPE DOOR CHECK

FIELD OF THE INVENTION

The present invention relates to that type of door check which utilizes a slotted hasp hinged on a vertical axis. A slide member secured to the door slides in the slot, permitting the door to be opened to a limited extent.

REFERENCE TO DISCLOSURE DOCUMENT

Much of the subject matter of the present invention is contained in Disclosure Document No. 092771 filed by the present inventors in the United States Patent and Trademark Office July 31, 1980. To the extent of common disclosure, the priority of that document is claimed.

BACKGROUND OF THE INVENTION

Door checks which provide for limited opening of a door, by use of a hasp hinged on a vertical axis and slotted to receive a headed slide bolt which projects from a housing mounted on the door projecting across the door edge, are well known. It is conventional that the housing which bears the slide bolt may have a flat inward vertical surface against which the hasp may be folded, the housing wall having a thumb screw over which the slot of the hasp may pass, to be turned to retain the hasp against the inner surface of the housing and thus serve as an additional locking device.

That construction permits only one extent of door opening. Hasp type devices have been patented, however, which permit at least two extents of door opening, for example, a narrow opening through which the persons inside and outside the door may converse or through which a letter may be passed, and a larger opening through which a small package may be passed; but such devices involved increased complexity. For example U.S. Pat. No. 1,785,772 to Hallman makes provision for hinging the plate which mounts the hasp to the door jamb, so that the hasp axis may be rotated out of vertical; and a somewhat similar provision is made in U.S. Pat. No. 179,308 to Hill. U.S. Pat. No. 197,577 to Whipple adds an axially sliding bolt to achieve retention in more than one position along the slotted hasp. In each of these devices, the slot in the hasp has but a single width, interrupted by notches which make possible the multiplicity of positions.

SUMMARY OF THE INVENTION

The objects of the present invention are to utilize a hasp whose hinge axis is fixed in a vertical position, to provide at least two extents of opening of the door check device. Still another object is to provide for quick change in the degree of opening; and as an additional object; to provide for easy installation without cutting into the trim which ordinarily projects inward a substantial fraction of an inch beyond the inner surface of the door. Still further objects will be apparent from the disclosure which follows.

We attain these purposes by the use of a hasp, conventionally mounted with its vertical hinge axis in fixed position a substantial fraction of an inch inward of the door inner surface, by providing the hasp with a slot which continues, from a conventional large yoke-like opening at the hinge, outward first in the provision of a slot of greater width, and continuing outward therefrom in the provision of a slot of narrower width. To fit within these two different widths, we utilize an axially fixed slide member having both a greater depth slide portion, to fit slidably within the slot portion of greater width, and a lesser depth portion, to fit slidably within the outward-continuing narrower width portion of the slot.

In one embodiment of our invention, the slide member is formed integrally with the vertical sheet metal wall of the housing affixed to the door. Since the inward extent of this housing approximates the thickness of the door trim, installation of this embodiment ordinarily requires no cutting of the door trim. In another embodiment, the two depths of slider are provided by use of an oblong member, rotatable through an angle of 90° to present, at the choice of the person inside the door, either the greater or lesser dimension of the oblong for sliding in such dual-width slot of the hasp. Thus when the greater dimension is presented vertically, the door can be opened only to the minimum extent; whereas by rotating 90°, the smaller dimension of the oblong is presented vertically, so that the slider may slide to the extreme end of the slot.

BRIEF DESCRIPTION OF THE DRAWINGS

FIG. 4 is an elevational view of alternate embodiment of the invention using a 90° rotatable oblong slide.

FIG. 5 is a cross-sectional view taken along line 5—5 of FIG. 4. The phantom lines show the position of the parts when the shallower slide is selected.

FIG. 6 is a right end view of FIG. 4. The phantom lines show the slide lever rotated up 90° to select such shallower slide.

DESCRIPTION OF THE PREFERRED EMBODIMENTS

Figure 1:
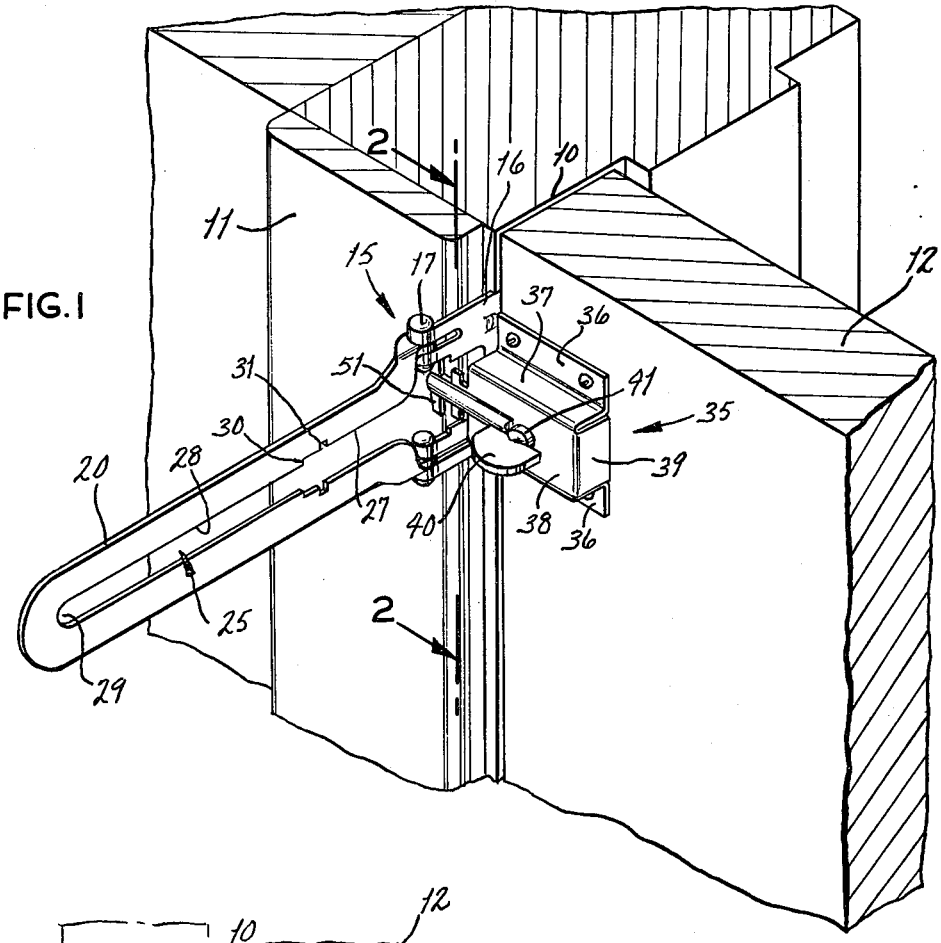
FIG. 1 is a perspective view showing a preferred embodiment of the present invention installed on the inner surface of a door, shown fragmentarily, in position prior to opening to engage the check.
Figure 2:
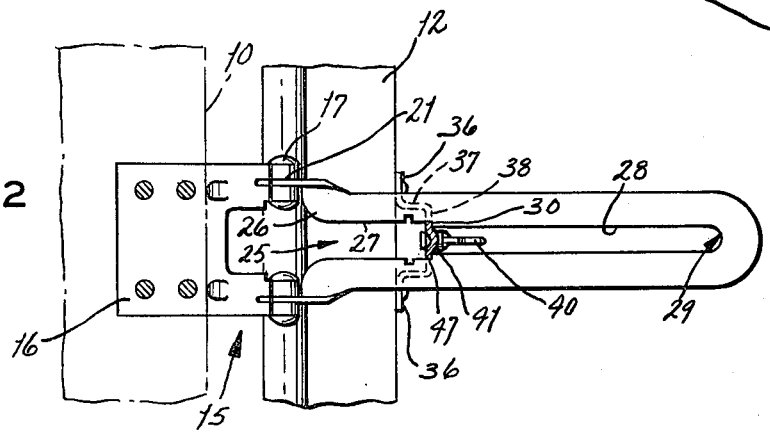
FIG. 2 is a view from the left end of FIG. 1 showing the slide with its deeper part engaged at the juncture of the broader and narrower parts of the hasp slot and with the door shown in minimum open position.
Figure 3:
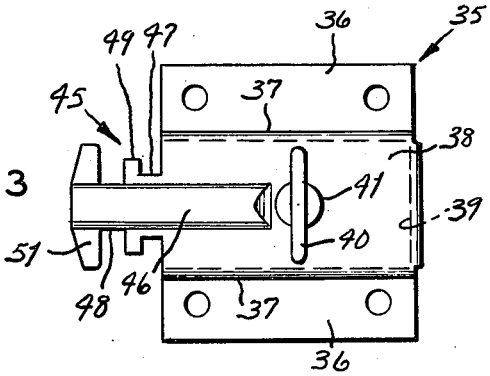
FIG. 3 is an elevational view of the integral housing and slide of FIG. 1.

The embodiment of invention shown in FIGS. 1–3 is to be installed preferably without disturbing the door trim/casing on its inner side. Such trim/casing normally extends about a half inch inward of the surface of a door. FIG. 1 shows fragmentarily such a door jamb 10, trim 11 and door 12.

This embodiment of the invention utilizes a hasp assembly generally designated 15 whose mounting plate 16 is mortised into the door jamb 10 by conventional one-way screws (not shown) having slots whose reverse face portions are so beveled as to make impossible removal with an ordinary screw driver. The mounting plate has a yoke-like clevis hing portion 17 defining a fixed vertical axis.

On the clevis hinge portion 15 is mounted a swinging hasp 20 having hinge lugs 21 complementary to the clevis hinge 17. A hasp slot generally designated 25 has a somewhat yoke-like broad entrant portion 26 leading curvingly into what is herein referred to as a broader slot portion 27, which may extend roughly one-third of the length of the hasp 20. The broader slot portion 27 leads in turn to a narrower slot portion 28 terminating in a slot end 29; the narrower slot portion 28 is preferably two or more times as long as the broader slot portion 27 and meets it at a shoulder-like juncture 30.

Inasmuch as the yoke-like entrant portion 26, broader slot portion 27 and narrower slot portion 28 are all formed symmetrically about a line perpendicular to the vertical axis of the clevis hinge 17 (which is mounted to be rigidly vertical), opening the door 12 on a vertical axis will draw the slide member, to be described, smoothly along such a perpendicular line.

Spacedly forward of the shoulder-like juncture 30 but preferably fairly close to it is a vertically enlarged passage notch 31, whose function will subsequently be described.

In contrast to the axially sliding bolt arrangement of U.S. Pat. No. 197,577, we utilize in this embodiment an integral housing and slide member generally designated 35, best seen in FIGS. 1 and 3. It is formed preferably as a sheet metal stamping to have a box-like configuration, including upper and lower flanges 36 to be screwed to the inner surface of the door as shown, with upper and lower box walls 37 projecting inward therefrom to an inward vertical wall 38. An outer end wall 39, bent forward from the vertical wall 37, affords a finished appearance to the stamping.

Mounted at about the middle of the inward vertical wall 38 is a thumb latch 40 having a short cylindrical shank 41 which is headed inwardly of the vertical wall 38, so that the latch 40 may be turned from horizontal position, shown in FIG. 1, to the vertical position shown in FIG. 3. In horizontal position, the thumb latch 40 will pass through the slot 25; when the door 12 is closed the swinging hasp 20 may be folded over the latch 40 and the hasp then locked in place by turning the latch to vertical position. This affords additional security, should the door be left otherwise unlocked or its lock tampered with.

Projecting horizontally from the inward vertical wall 38 is an integral key-like slide manner generally designated 45. Preferably it has a stamped central reinforcing rib 46 which extends horizontally through a substantial portion of the inward vertical wall 38, bending it slightly out of vertical as shown; this affords extra bending strength perpendicular to the original vertical plane of the sheet metal. Extending symmetrically on the upper and lower sides of the slide member 45, to the left of the vertical wall 38 as seen in FIG. 3, is a deeper slide portion 47, of such width as to fit slidably within the broader slot portion 27 of the hasp 20; and a shallower slide portion 48, whose depth is such to fit slidably within the narrower hasp slot portion 28. Between the two slide portions 47, 48 is a separator or guard portion 49, too deep to fit within the broader slot portion 27, but of slightly less depth than the total depth of the passage notch 31 in the hasp 20. Finally, at the outermost end of the integral slide member 45 is a vertically enlarged tip portion 51 whose extent is greater than such depth of the passage notch 31 but less than the height of the yoke in the mounting plate clevis hinge 17 or the height of the yoke-like entrant portion 26 of the hasp slot 25.

The components described are mounted in the manner shown in FIG. 1. The integral housing and slide member 45 is mounted adjacent to the inward-opening edge of the door 12 with the slide member 45 projecting precisely horizontally parallel to such door inner surface as there shown, to present the vertically enlarged tip portion 51 just beyond the vertical axis of the clevis hinge 17 of the mounting plate 16. Because of the inward extent of the housing vertical wall 37 from the inner surface of the door 12, the key-like slide portion 47 will normally clear the door trim 11 without any cutting away, which greatly facilitates installation as compared with conventional swinging hasp door checks. The vertical axis of the clevis hinge 17 is so positioned that when the swinging hasp 20 is folded it will fit flatwise against the housing inward wall 38 for securement; it fits about the cylindrical shank 41 of the thumb latch 40 to permit turning to the vertical locking position shown in FIG. 3. If the user wishes to open the door completely, he merely turns the thumb latch 41 horizontally and swings the hasp 20 to the left of the FIG. 1 position, so that the slide member tip portion 51 may, on opening, move without interference through the yoke-like entrant portion 26 of the hasp 20.

If the user wishes to open the door only slightly and there check its movement, as shown in FIG. 2, he swings the hasp 20 far enough to the right to utilize its broader slot portion 27 over the deeper slide portion 47, and opens the door inward as shown in FIG. 2. The upper and lower edges of the deeper slide portion 47 will thus come to a stop against the shoulder-like juncture 30 at the entrance to the narrower slot portion 28. The user will thus be secure; the extent of the door opening is too slight to permit the insertion of a tool or any other manipulation which might endanger those inside. If it were otherwise possible to deflect the hasp 20 angularly, the separator or guard portion 49 makes such angular movement impossible when the slide member 45 is engaged against the shoulder 30 as shown in FIG. 2.

Should the user desire to permit the door to be opened somewhat farther, so that a parcel may be handed through the opening, for example, he presses the door slightly toward the jamb, bringing the slide member 45 into alignment with the passage notch 31. Then, on passing the guard portion 49 through the passage notch 31, the hasp 20 may be moved angularly until stopped by the vertically enlarged slide tip portion 51. This permits the user to open the door farther inward, with the shallower slide portion 48 sliding in the hasp narrower slot portion 28 until it comes to rest against the hasp slot end 29.

The alternate embodiment, illustrated in FIGS. 4, 5 and 6 likewise affords two degrees of opening, utilizing, however, different mechanism for this purpose.

A hasp assembly 15' is identical, save for lack of a passage notch, with the hasp assembly of the prior embodiment; and it is similarly installed. The slot 25' in its swinging hasp 20' has a yoke-like entrant portion 26', a broader slot portion 27' and a narrower slot portion 28', the latter meeting at a shoulder-like juncture 30', as in the previous embodiment. The extent of the broader slot portion 27' from the yoke-like entrant portion 26' to the shoulder-like juncture 30' may be the same as in the first described embodiment; and likewise the length of the narrower slot portion 28' to the slot end 29'.

A box-like housing generally designated 55 is formed as a heavy sheet metal stamping, having upper and lower flanges 56 to be screwed to the door inner surface, inward projecting upper and lower box walls 57, a vertical inward wall 58, a partial outer end wall 59 hereinafter referred to, and a complete inner end wall 62. A thumb latch 40' having a cylindrical shank 41', identical to the corresponding parts of the prior described embodiment, is similarly mounted in the middle of the inward vertical wall 58.

Horizontally aligned bores 63 are provided in the inner end wall 62 and outer end wall 59 to receive a round selector shaft 65, having at its outer end, shown to the right in FIG. 4, a 90° bent lever portion 66. Angular movement of the selector shaft 65 in the bores 63 is limited to 90° by tab-like end stops 67, blanked and bent upward and slatingly toward each other from portions of the outer end wall 59, as shown in FIGS. 4 and 6. If desired, other 90° stop means may be utilized.

At the inner end of the selector shaft 65, opposite to the bent lever end 66, is rigidly mounted a slide member generally designated 70, designed to cooperate with the swinging hasp 20'. The slide member 70, seen in elevation in FIG. 4, has a head end 71 which may be round; it is of greater vertical extent than the broader slot portion 27' but sufficiently small to fit within the yoke-like entrant portion 26' of the hasp 20'. Between the head end 71 and the inner end wall 62 of the housing 55, the slide member 70 has an oblong slide portion 72, best seen in cross-section in FIG. 5. Specifically, its surface of smaller area 73, shown above and below in solid lines of FIG. 5, are so spaced apart as to effect a sliding fit within the broader slot portion 27' of the swinging hasp 20'; while its larger faces 74 are spaced more closely, at a spacing designed to fit slidably within the narrower slot portion 28'.

Rotating the selector shaft 65 by moving its lever end 66 from the lower position shown in solid lines in FIGS. 4, 5 and 6 to the upper phantom lines positions of FIGS. 5 and 6 (in both cases against the bent limit stops 67), turns the oblong slide portion 72 from the solid line position shown in cross-section in FIG. 5 to the phantom line position there shown. Utilizing the phantom line position of the oblong slide portion 72, the door can open to the fullest extent permitted by the narrower slot portion 28' of the hasp 20'; whereas if the solid line position of the lever 66 is selected, after the hasp 20' is in place the oblong slide portion 72 can slide only as far as the shoulder-like juncture 30', limiting the door opening to the same extent as shown in FIG. 2 for the first embodiment.

Utilizing either of these embodiments, a selection of two extents of opening is afforded to the user without danger of tampering from the outside by someone who has induced the user to open the door slightly. For lower manufacturing cost and installation without substantially cutting the door trim, the first embodiment may be preferred.

From this disclosure, modification will be apparent. For example, door checks providing three extents of opening may be constructed in the manner of the first embodiment herein; and other variations in detailed features of construction and use will be suggested to those familiar with the door-check art.

In the claims, the terms "broader" and "narrower" as referring to portions of the slot in the hasp, are to be taken as measured vertically, as are the terms "deeper" and "shallower" in referring to portions of the slide.

We claim:

1. A door check of the type having, for affixing to the inner surface of a door jamb, a hasp hinged on a fixed vertical axis, the hasp being elongated and having perpendicular to said axis an elongated slot terminating at the hinge axis in an enlarged yoke-like opening, the door check further having, for affixing to the inner surface of a door, a slide-supporting member from which a headed slide member projects horizontally parallel to such door surface, for reception within the opening of the hasp for sliding within its slot, characterized in that:

A. the slot has, continuing from the yoke-like opening, a broader slot portion extending to a shoulder-like junction, from which a narrower slot portion continues, and B. the slide member has a deeper portion slidable within the broader slot portion and a shallower slide portion alternatively slidable within the narrower slot portion, and terminates in a head whose depth is less than such yoke-like opening and greater than either said slot portions, whereby by moving the hasp on its hinge and on fitting the slide member head through the yoke-like opening, a person inside the door may select between the extent of opening permitted by the said two slot portions.

2. A door check as defined in claim 1, further characterized in that the slide-supporting member is a housing formed of bent sheet metal and has an inward presented substantially vertical housing wall, and the slide member is an integral projection from said housing wall and has, spaced axially along its said axial projection, the said deeper slide portion and the said shallower slide portion, and terminates in an outer end portion vertically enlarged greater than the said deeper slide portion, whereby said outer end portion serves as the head of said integral slide member.

3. A door check as defined in claim 2, wherein said integral projection is substantially in the plane of said vertical wall of the housing, whereby to avoid or minimize cutting away trim around a door frame which projects inwardly of the door inner surface.

4. A door check as defined in claim 2, wherein said deeper and shallower slide portions are separated by a guard portion of depth greater than such deeper portion but of lesser depth than said head end portion, and wherein the hasp has a vertically enlarged passage notch in the broader slot portion in advance of said shoulder-like junction, the passage notch being of sufficient height to permit passage of said guard portion of said slide member but insufficient to permit passage of its said head portion.

5. A door check as defined in claim 1, wherein the slide-support member includes means to permit said slide member to rotate, and said slide member is of oblong cross-section inward of its head, and has means for manually rotating it, and said deeper and shallower slide portions are provided by rotating said slide 90°, whereby to select between use of the vertically more closely spaced faces of said oblong cross-section portion of the slide member, thereby to provide said shallower slide portion, or the more widely spaced faces, thereby to provide the deeper slide portion.

* * * * *

UNITED STATES PATENT AND TRADEMARK OFFICE

CERTIFICATE OF CORRECTION

PATENT NO. : 4,436,331

DATED : March 13, 1984

INVENTOR(S) : Howard E. Glickman, Alan J. Broddon and Norman C. Broddon

It is certified that error appears in the above-identified patent and that said Letters Patent is hereby corrected as shown below:

Col. 2, line 60, delete "hing" and substitute ---hinge---.
Col. 3, line 40, delete "manner" and substitute ---member---.
Col. 5, line 9, delete "slatingly" and substitute ---slantingly---.
Col. 5, line 22, insert ---s--- after "surface".

Signed and Sealed this

*Twenty-ninth* Day of *May 1984*

[SEAL]

*Attest:*

GERALD J. MOSSINGHOFF

*Attesting Officer*

*Commissioner of Patents and Trademarks*